US007375704B2

(12) United States Patent
Chen et al.

(10) Patent No.: US 7,375,704 B2
(45) Date of Patent: May 20, 2008

(54) PLASMA DISPLAY PANEL DRIVING CIRCUIT

(75) Inventors: Bi-Hsien Chen, Ping-Tung Hsien (TW); Yi-Min Huang, Taipei (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 188 days.

(21) Appl. No.: 11/425,713

(22) Filed: Jun. 22, 2006

(65) Prior Publication Data

US 2006/0290607 A1 Dec. 28, 2006

Related U.S. Application Data

(60) Provisional application No. 60/595,304, filed on Jun. 22, 2005.

(51) Int. Cl.
*G09G 3/28* (2006.01)

(52) U.S. Cl. ..... 345/66; 345/63

(58) Field of Classification Search ..... 345/37, 345/41, 42, 60, 63, 66; 315/169.3, 169.4; 313/567

See application file for complete search history.

(56) References Cited

U.S. PATENT DOCUMENTS 5,828,353 A 10/1998 Kishi et al.
6,628,275 B2 * 9/2003 Vossen et al. ..... 345/211
6,680,581 B2 * 1/2004 Lee et al. ..... 315/169.3
6,768,270 B2 * 7/2004 Chae ..... 315/169.3
6,781,322 B2 * 8/2004 Onozawa et al. ..... 315/169.3
6,933,679 B2 * 8/2005 Lee et al. ..... 315/169.4
6,961,031 B2 * 11/2005 Lee et al. ..... 345/60
7,023,139 B2 * 4/2006 Lee et al. ..... 315/169.1
7,027,010 B2 * 4/2006 Lee ..... 345/60
7,123,219 B2 * 10/2006 Lee ..... 345/76
7,176,854 B2 * 2/2007 Lee et al. ..... 345/60
2003/0173905 A1 * 9/2003 Lee et al. ..... 315/169.3
2003/0193454 A1 * 10/2003 Lee et al. ..... 345/63
2004/0012546 A1 * 1/2004 Takagi et al. ..... 345/60
2004/0135746 A1 * 7/2004 Lee et al. ..... 345/60
2006/0238447 A1 * 10/2006 Chen ..... 345/60
2006/0267874 A1 * 11/2006 Chen et al. ..... 345/68

* cited by examiner

*Primary Examiner*—Ricardo Osorio
(74) *Attorney, Agent, or Firm*—Winston Hsu

(57) ABSTRACT

A driving circuit for producing sustain waveforms of a plasma display panel (PDP) is mentioned. The driving circuit includes the functions of voltage clamping and energy recovery. By controlling switches contained in the driving circuit, the supplied voltage source can be made to be only half of the sustain voltage. The voltage stress of some components will therefore be lower. In addition, the numbers of components can be reduced in the driving circuit.

27 Claims, 12 Drawing Sheets

PLASMA DISPLAY PANEL DRIVING CIRCUIT

CROSS REFERENCE TO RELATED APPLICATIONS

This application claims the benefit of the filing date of U.S. provisional patent application No. 60/595,304, filed Jun. 22, 2005, the contents of which are hereby incorporated by reference.

BACKGROUND OF THE INVENTION

1. Field of the Invention

The present invention relates to a driving circuit, and more specifically, to a driving circuit for a plasma display panel (PDP).

2. Description of the Prior Art

In recent years, there has been an increasing demand for planar displays such as plasma display panels (PDP), liquid-crystal displays (LCD) and electroluminescent displays (EL display) in place of cathode ray tube terminals (CRT) due to the advantage of the thin appearance of the planar displays.

In a PDP display, charges are accumulated according to display data, and a sustaining discharge pulse is applied to paired electrodes in order to generate discharge glow for display. As far as the PDP display is concerned, it is required to apply a high voltage to the electrodes. In particular, a pulse-duration of several microseconds is usually adopted. Hence the power consumption of the PDP display is quite considerable. Energy recovering (power saving) is therefore sought for. Many designs and patents have been developed for providing methods and apparatuses of energy recovering for PDPs. One of the examples is U.S. Pat. No. 5,828,353, "Drive Unit for Planar Display" by Kishi, et al., which is included herein by reference.

Please refer to FIG. 1. FIG. 1 is a block diagram of a prior art plasma panel display driving circuit 100. An equivalent capacitor of a plasma display panel is marked as Cp. The conventional driving circuit 100 includes four switches S1 to S4 for passing current, an X-side energy recovery circuit 110 and a Y-side energy recovery circuit 120 for charging/discharging the panel equivalent capacitor Cp from the X side of the panel equivalent capacitor Cp and the Y side of the panel equivalent capacitor Cp respectively. S5, S6, S7 and S8 are switches for passing current. D5, D6, D7 and D8 are diodes. V1 and V2 are two voltage sources. C1 and C2 are capacitors adopted for recovering energy, and L1 and L2 are resonant inductors. The X-side energy recovery circuit 110 includes an energy-forward channel comprising the switch S6, the diode D6 and the inductor L1, and an energy-backward channel comprising the inductor L1, the diode D5 and the switch S5. Similarly, the Y-side energy recovery circuit 120 also includes an energy-forward channel comprising the switch S8, the diode D8 and the inductor L2, and an energy-backward channel comprising the inductor L2, the diode D7 and the switch S7.

Please refer to FIG. 2. FIG. 2 is a flowchart of generating the sustaining pulses of the equivalent panel equivalent capacitor Cp of the PDP by the conventional driving circuit 100 illustrated in FIG. 1.

Step 200: Start;

Step 210: Keep the voltage potentials at the X side and the Y side of the panel equivalent capacitor Cp at ground by turning on the switches S3 and S4;

Step 220: Charge the X side of the panel equivalent capacitor Cp by the capacitor C1 and keep the voltage potential at the Y side of the panel equivalent capacitor Cp at ground by turning on the switches S6 and S4; wherein the voltage potential at the X side of the panel equivalent capacitor Cp goes up to V1 accordingly;

Step 230: Supply charge to the equivalent panel equivalent capacitor Cp of the PDP from the X side by turning on the switches S1 and S4; wherein the voltage potential at the X side of the panel equivalent capacitor Cp keeps at V1 and the voltage potential at the Y side of the panel equivalent capacitor Cp keeps at ground accordingly;

Step 240: Discharge the panel equivalent capacitor Cp from the X side and keep the voltage potential at the Y side of the panel equivalent capacitor Cp at ground by turning on the switches S5 and S4; wherein the voltage potential at the X side of the panel equivalent capacitor Cp goes down to ground accordingly;

Step 250: Keep the voltage potentials at the X side and the Y side of the panel equivalent capacitor Cp at ground by turning on the switches S3 and S4;

Step 260: Charge the Y side of the panel equivalent capacitor Cp by the capacitor C2 and keep the voltage potential at the X side of the panel equivalent capacitor Cp at ground by turning on the switches S8 and S3; wherein the voltage potential at the Y side of the panel equivalent capacitor Cp goes up to V2 accordingly;

Step 270: Supply charge to the equivalent panel equivalent capacitor Cp of the PDP from the Y side by turning on the switches S2 and S3; wherein the voltage potential at the Y side of the panel equivalent capacitor Cp keeps at V2 and the voltage potential at the X side of the panel equivalent capacitor Cp keeps at ground accordingly;

Step 280: Discharge the panel equivalent capacitor Cp from the Y side and keep the voltage potential at the X side of the panel equivalent capacitor Cp at ground by turning on the switches S7 and S3; wherein the voltage potential at the Y side of the panel equivalent capacitor Cp goes down to ground accordingly;

Step 290: Keep the voltage potentials at the X side and the Y side of the panel equivalent capacitor Cp at ground by turning on the switches S3 and S4;

Step 295: End.

Please refer to FIG. 3. FIG. 3 shows a diagram illustrating the voltage potentials at the X side and the Y side of the panel equivalent capacitor Cp, and the control signals, M1 to M8, of the switches S1 to S8 in FIG. 1 respectively. In FIG. 3, the horizontal axis represents the time, while the vertical axis represents the voltage potential. Note that the switches S1 to S8 are designed to close (turned on) for passing current when the control signal is high, and to open (turned off) such that no current can pass when the control signal is low.

Conventionally, the energy recovery (power saving) circuit provides two individual channels of charging and discharging the equivalent capacitor respectively (energy-forward channel and energy-backward channel) for each side of the equivalent panel equivalent capacitor Cp. Therefore, the amount of required components is quite large. Furthermore, the circuit area of capacitors C1 and C2 is usually considerable. Hence the cost of energy recovery circuit is not easy to reduce.

SUMMARY OF THE INVENTION

It is therefore an objective of the invention to provide plasma display panel driving circuits that solve the problems of the prior art.

According to a preferred embodiment of the present invention, a claimed plasma display panel driving circuit includes a panel capacitor a first side and a second side; a first switch electrically connected between the first side of the panel capacitor and a first voltage; a first inductor and a second switch electrically connected in series between the first side of the panel capacitor and a first node; a third switch electrically connected between the first side of the panel capacitor and the first node; a fourth switch electrically connected between the first node and a second voltage; a fifth switch electrically connected between the second voltage and a second node; a first capacitor electrically connected between the first node and the second node; a sixth switch electrically connected between the second node and the third voltage; a seventh switch electrically connected between the second side of the panel capacitor and a fourth voltage; a second inductor and an eighth switch electrically connected in series between the second side of the panel capacitor and a third node; a ninth switch electrically connected between the second side of the panel capacitor and the third node; a tenth switch electrically connected between the third node and a fifth voltage; an eleventh switch electrically connected between the fifth voltage and a fourth node; a second capacitor electrically connected between the third node and the fourth node; and a twelfth switch electrically connected between the fourth node and the sixth voltage.

According to another preferred embodiment of the present invention, a claimed plasma display panel driving circuit includes a panel capacitor having a first side and a second side; a first switch electrically connected between the first side of the panel capacitor and a first voltage; a second switch electrically connected between the second side of the panel capacitor and a second voltage; a third switch electrically connected between the second side of the panel capacitor and a first node; a fourth switch and a first inductor electrically connected in series between the second side of the panel capacitor and the first node; a fifth switch and a second inductor electrically connected in series between the first side of the panel capacitor and the first node; a sixth switch electrically connected between the first side of the panel capacitor and the first node; a seventh switch electrically connected between the first node and a third voltage; an eighth switch electrically connected between the third voltage and a second node; a capacitor electrically connected between the first node and the second node; and a ninth switch electrically connected between the second node and a fourth voltage.

According to yet another preferred embodiment of the present invention, a claimed plasma display panel driving circuit includes a panel capacitor having a first side and a second side; a first switch electrically connected between the first side of the panel capacitor and a first voltage; a second switch electrically connected between the second side of the panel capacitor and a second voltage; a third switch electrically connected between the first side of the panel capacitor and a first node; a fourth switch electrically connected between the second side of the panel capacitor and the first node; an inductor electrically connected between the first node and a second node; a fifth switch electrically connected between the first node and the second node; a sixth switch electrically connected between the second node and a third voltage; a seventh switch electrically connected between the third voltage and a third node; a capacitor electrically connected between the second node and the third node; and an eighth switch electrically connected between the third node and a fourth voltage.

It is an advantage that the voltage potential output by the voltage sources is only half of the sustaining voltage produced by the driving circuit. The voltage stress of some components in the driving circuit will therefore be lower. In addition, the numbers of components can be reduced in the driving circuit.

These and other objectives of the present invention will no doubt become obvious to those of ordinary skill in the art after reading the following detailed description of the preferred embodiment that is illustrated in the various figures and drawings.

DETAILED DESCRIPTION

The present invention provides plasma display panel driving circuits that allow the supplied voltage to be just half of the produced sustaining voltage. The advantages of this invention are that the supplied voltage will be around half of that of the prior art. The voltage stress of some components will therefore be lower. In addition, the numbers of components can be reduced in the driving circuits.

Figure 1:
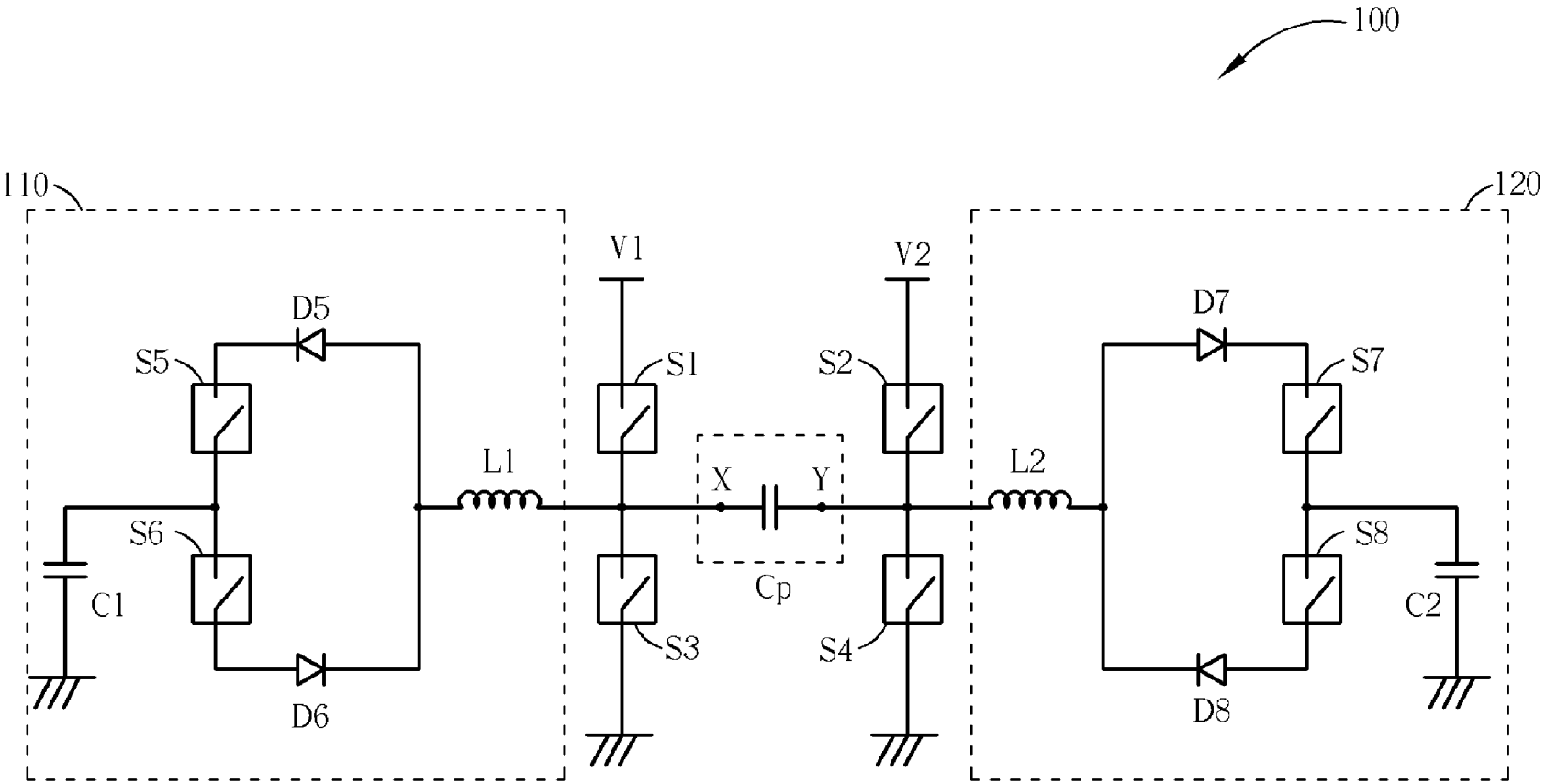
Fig. 1 Prior art
FIG. 1 is a driving circuit diagram of a prior art energy recovery circuit with an equivalent capacitor of a PDP.
Figure 2:
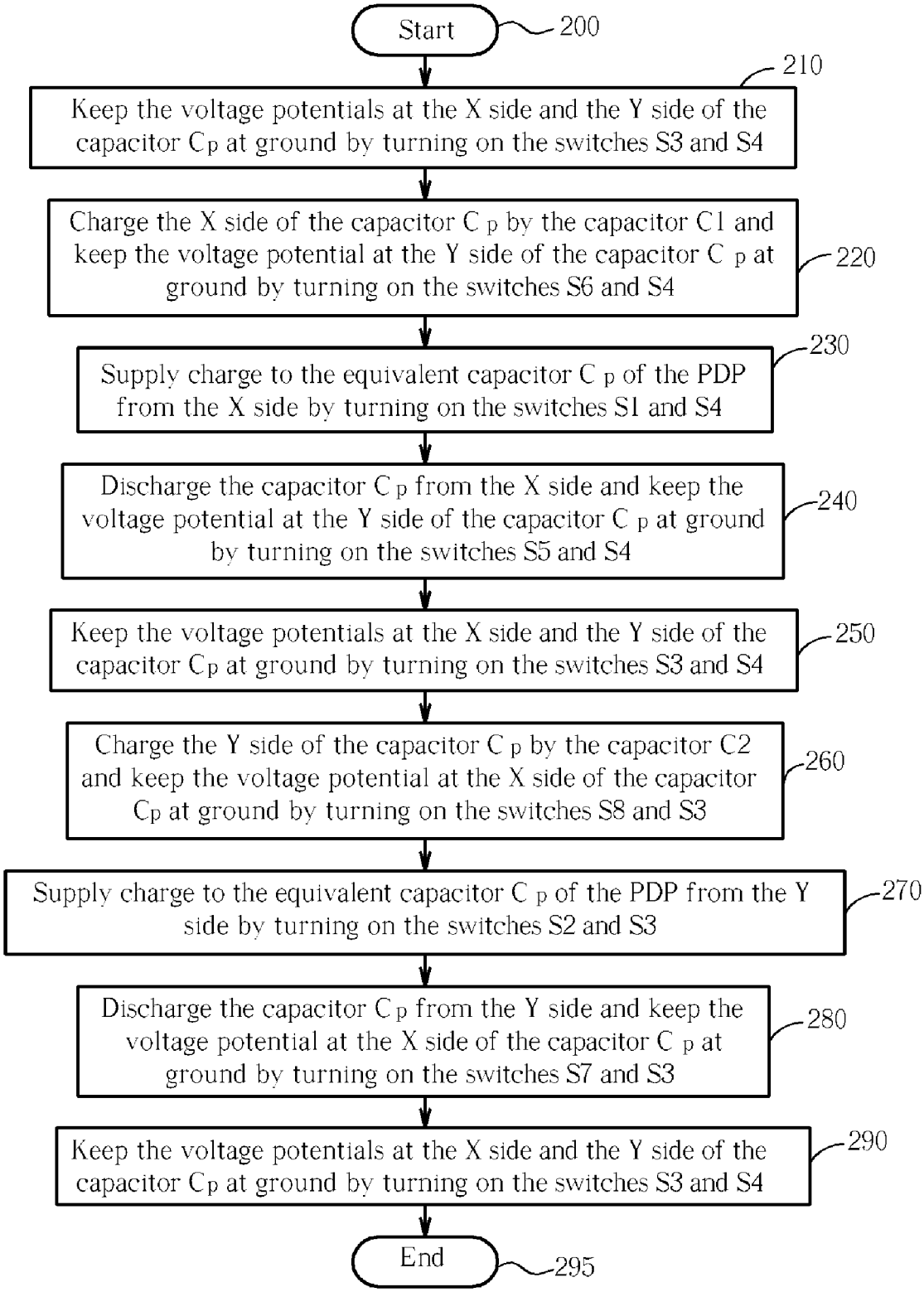
Fig. 2 Prior art
FIG. 2 is a flowchart of a prior art method of generating the sustaining pulses of the equivalent panel equivalent capacitor Cp.
Figure 3:
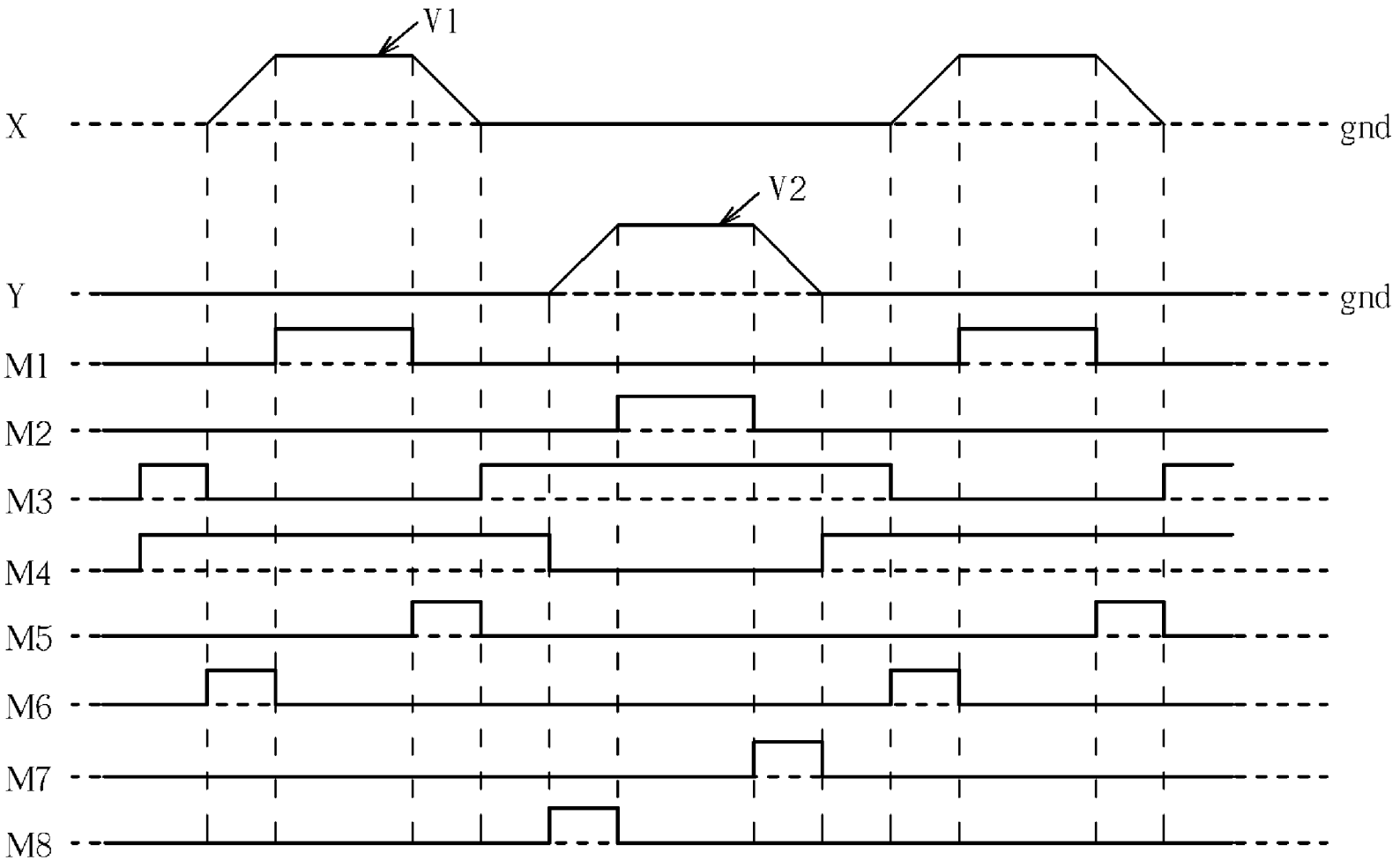
Fig. 3 Prior art
FIG. 3 is a diagram illustrating the voltage potentials at sides of the panel equivalent capacitor Cp and the control signals of the switches.
Figure 4:
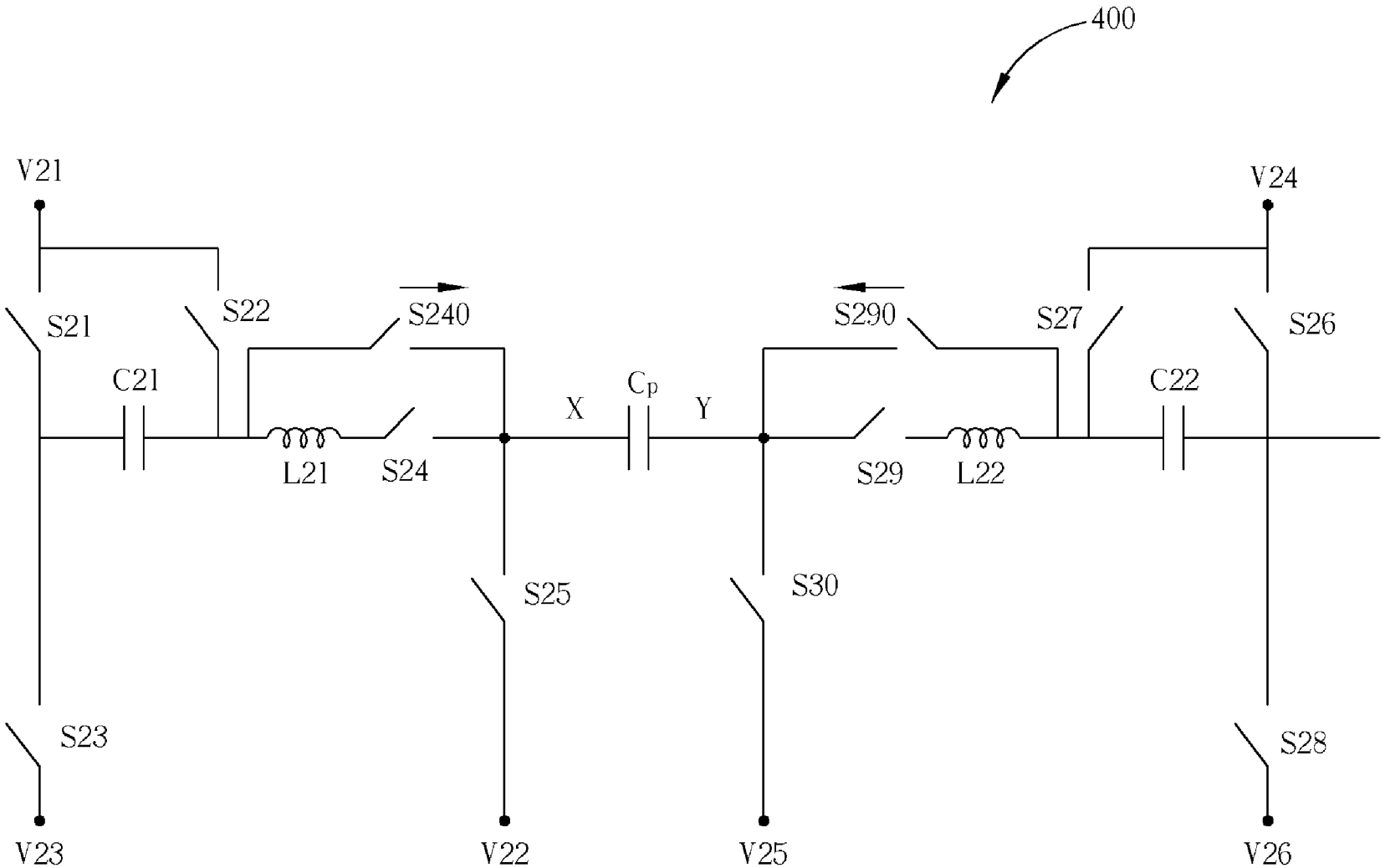
FIG. 4 shows a circuit diagram of a plasma display panel driving circuit according to a first embodiment of the present invention.

Please refer to FIG. 4. FIG. 4 shows a circuit diagram of a plasma display panel driving circuit 400 according to a first embodiment of the present invention. The driving circuit 400 is shown having an equivalent panel equivalent capacitor Cp of the PDP, and has an X side and a Y side. The driving circuit 400 comprises switches S21 to S30, S240, and S290, capacitors C21 and C22, inductors L21 and L22, and voltage sources V21 to V26. Switches S240 and S290 are unidirectional switches, and the direction of the current is indicated by the arrows in FIG. 4. The current direction of switch S240 is toward the X side of the panel equivalent capacitor Cp, and the current direction of switch S290 is toward the Y side of the panel equivalent capacitor Cp. The voltage potential output by voltage source V21 is greater than that of the voltage sources V22 and V23. Likewise, the voltage potential output by the voltage source V24 is greater than that of the voltage sources V25 and V26. The voltage potentials output by the voltage sources V21 and V24 can be the same or can be different. Similarly, the voltage potentials output by the voltage sources V22 and V23 and the voltage sources V25 and V26 can be the same or can be different. Inductor L21 and switch S24 are electrically connected in series, as are inductor L22 and switch S29.

Figure 5:
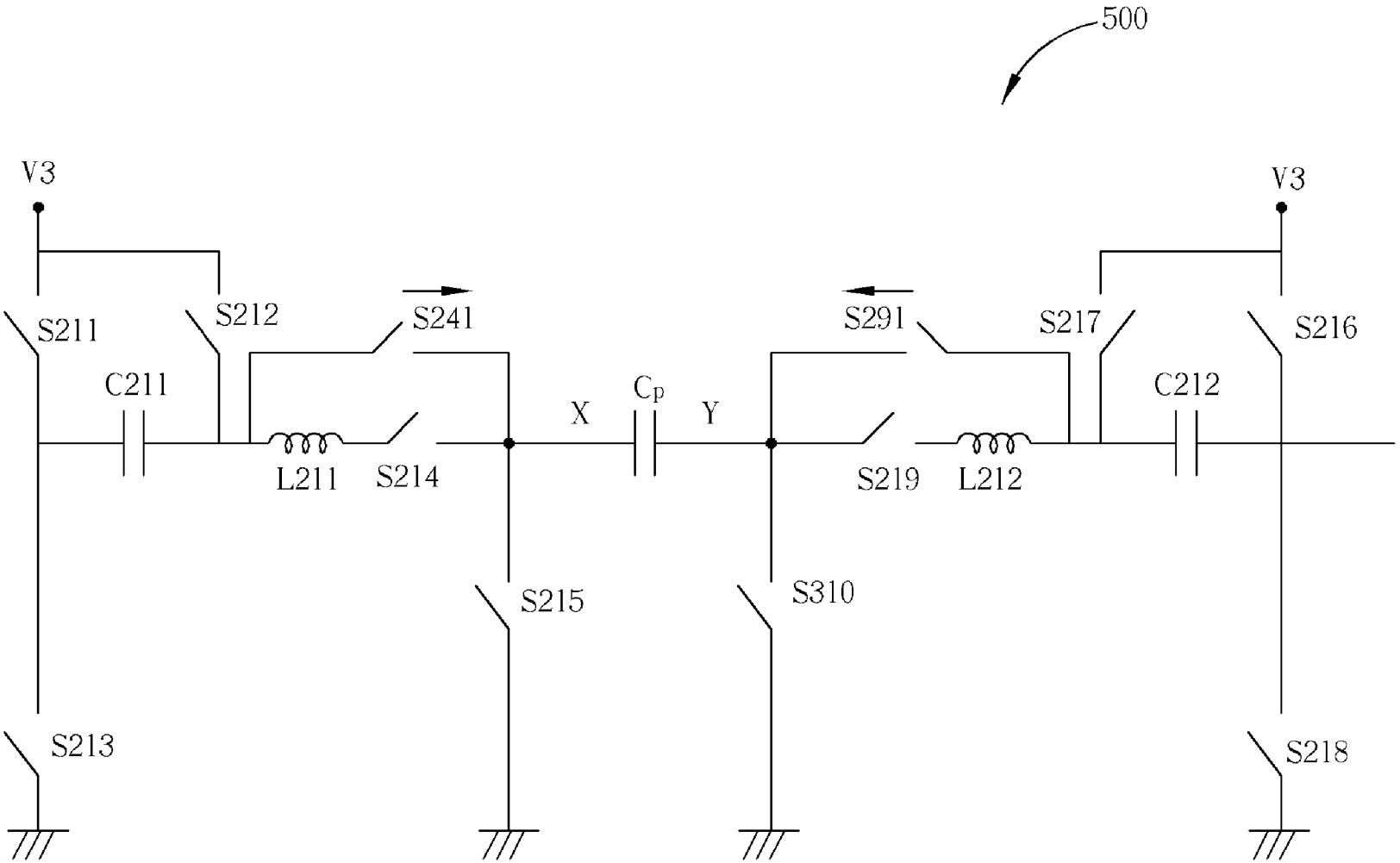
FIG. 5 is shows a circuit diagram of a plasma display panel driving circuit according to a second embodiment of the present invention.

Please refer to FIG. 5. FIG. 5 is shows a circuit diagram of a plasma display panel driving circuit 500 according to a second embodiment of the present invention. The driving circuit 500 is a special case of the driving circuit 400 shown in FIG. 4 in which the voltage sources V21 and V24 are the same positive voltage sources, and are labeled as V3 in FIG. 5. In addition, voltage sources V22, V23, V25, and V26 are all ground. All other components of the driving circuit 500 are the same as the driving circuit 400, and switches S211 to S219, S310, S241, and S291, inductors L211 and L212, and capacitors C211 and C212 correspond to switches S21 to S30, S240, and S290, inductors L21 and L22, and capacitors C21 and C22, respectively.

Figure 6:
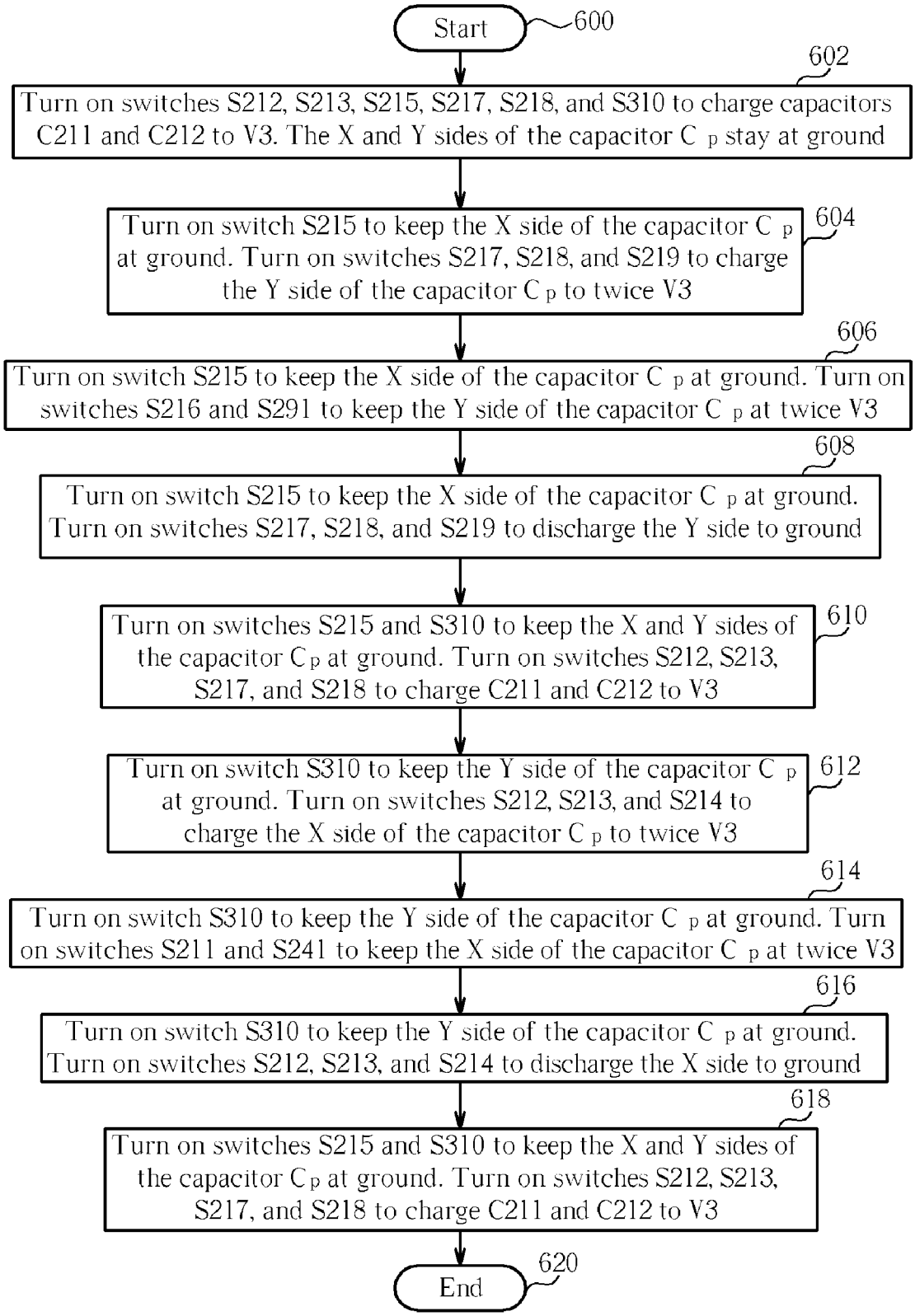
FIG. 6 is a flowchart illustrating the operation of the driving circuit of the second embodiment for creating a sustain waveform.

Please refer to FIG. 6, which illustrates the operation of the driving circuit 500 of the second embodiment for creating a sustain waveform. Steps contained in the flowchart will be explained as follows.

Step 600: Start.

Step 602: The switches S212, S213, S215, S217, S218, and S310 are turned on. The capacitors C211 and C212 are charged to the voltage potential of V3. The positive terminal of C211 is at the node of the connection of S212 and S241. The positive terminal of C212 is at the node of the connection of S217 and S291. The X side and Y side of the panel equivalent capacitor Cp keep at ground.

Step 604: Keep the voltage potential at the X side of the panel equivalent capacitor Cp at ground by turning on the switch S215. Charge the Y side of the panel equivalent capacitor Cp by turning on the switches S217, S218, and S219. The voltage potential at Y side of the panel equivalent capacitor Cp goes up to twice the voltage potential of V3 through the components S217, S218, S219, L212, and C212.

Step 606: Keep the voltage potential at the X side of the panel equivalent capacitor Cp at ground by turning on the switch S215. Keep the voltage potential at the Y side of the panel equivalent capacitor Cp at twice the voltage potential of V3 by turning on the switches S216 and S291.

Step 608: Keep the voltage potential at the X side of the panel equivalent capacitor Cp at ground by turning on the switch S215. Discharge the Y side of the panel equivalent capacitor Cp by turning on the switches S217, S218, and S219. The voltage potential at Y side of the panel equivalent capacitor Cp goes down to ground through the components S217, S218, S219, L212, and C212.

Step 610: Keep the voltage potential at the X side of the panel equivalent capacitor Cp at ground by turning on the switch S215. Keep the voltage potential at the Y side of the panel equivalent capacitor Cp at ground by turning on the switch S310. In the meantime, the switches S212 and S213 are turned on for charging C211 to V3. The switches S217 and S218 are turned on for charging C212 to V3.

Step 612: Keep the voltage potential at the Y side of the panel equivalent capacitor Cp at ground by turning on the switch S310. Charge the X side of the panel equivalent capacitor Cp by turning on the switches S212, S213, and S214. The voltage potential at X side of the panel equivalent capacitor Cp goes up to twice the voltage potential of V3 through the components S212, S213, S214, L211, and C211.

Step 614: Keep the voltage potential at the Y side of the panel equivalent capacitor Cp at ground by turning on the switch S310. Keep the voltage potential at the X side of the panel equivalent capacitor Cp at twice the voltage potential of V3 by turning on the switches S211 and S241.

Step 616: Keep the voltage potential at the Y side of the panel equivalent capacitor Cp at ground by turning on the switch S310. Discharge the X side of the panel equivalent capacitor Cp by turning on the switches S212, S213, and S214. The voltage potential at X side of the panel equivalent capacitor Cp goes down to ground through the components S212, S213, S214, L211, and C211.

Step 618: Keep the voltage potential at the Y side of the panel equivalent capacitor Cp at ground by turning on the switch S310. Keep the voltage potential at the X side of the panel equivalent capacitor Cp at ground by turning on the switch S215. In the meantime, the switches S212 and S213 are turned on for charging C211 to V3. The switches S217 and S218 are turned on for charging C212 to V3.

Step 620: End.

It is also allowed to keep the voltage potentials at the X and/or Y sides of the panel equivalent capacitor Cp at twice the voltage potential of V3 when the other side of the panel equivalent capacitor Cp is charged or discharged. In addition, it is also allowed to charge and discharge the X side of the panel equivalent capacitor Cp during the periods of discharging and charging the Y side of the panel equivalent capacitor Cp, respectively.

Figure 7:
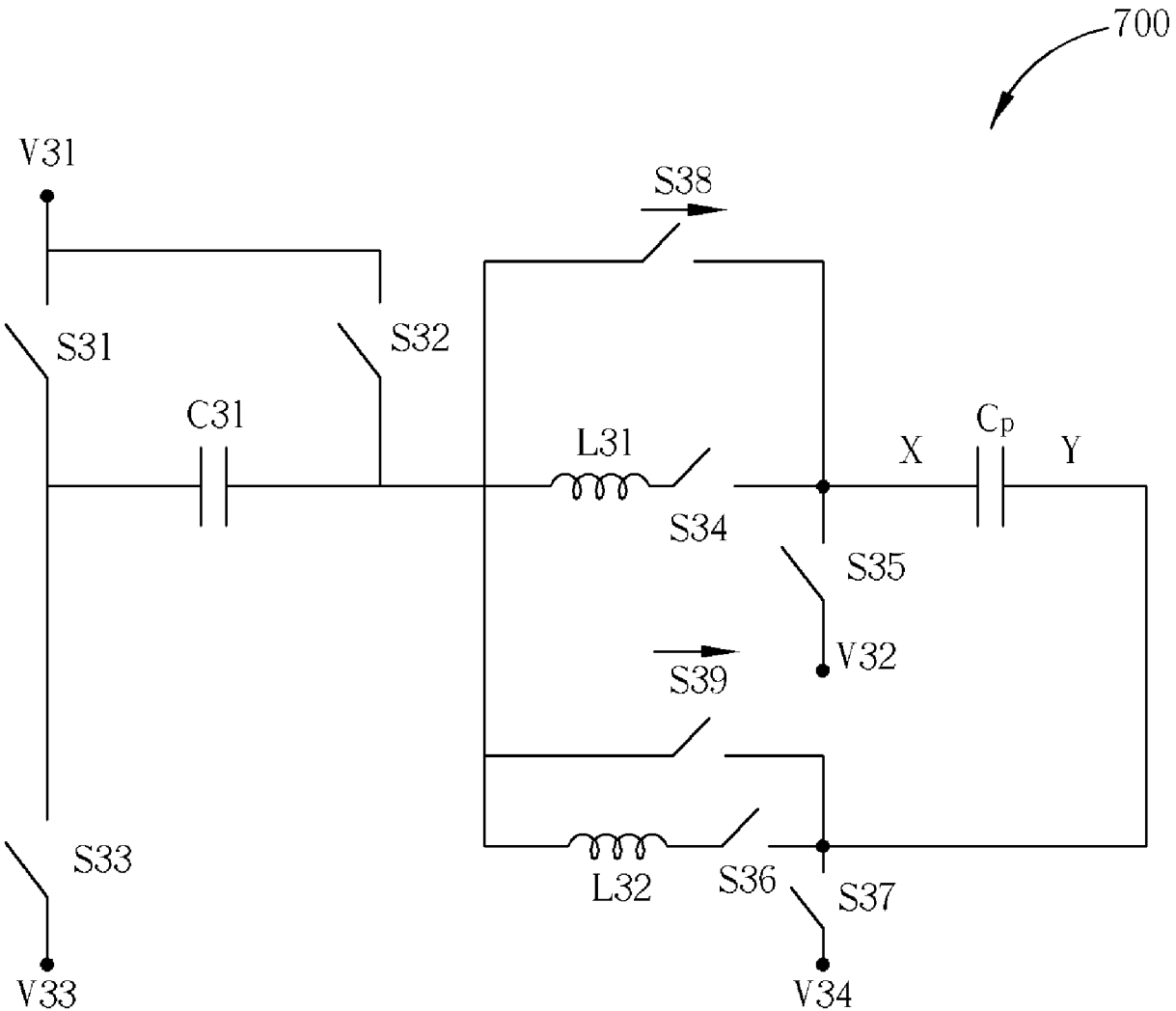
FIG. 7 shows a circuit diagram of a plasma display panel driving circuit according to a third embodiment of the present invention.

Please refer to FIG. 7. FIG. 7 shows a circuit diagram of a plasma display panel driving circuit 700 according to a third embodiment of the present invention. The driving circuit 700 comprises switches S31 to S39, a capacitor C31, inductors L31 and L32, and voltage sources V31 to V34. The driving circuit 700 has an equivalent panel equivalent capacitor Cp of the PDP, which has an X side and a Y side. Switches S38 and S39 are unidirectional switches. As indicated by the arrows in FIG. 7, the current direction of switch S38 is toward the X side of panel equivalent capacitor Cp and the current direction of switch S39 is toward the Y side of panel equivalent capacitor Cp. The voltage potential output by voltage source V31 is greater than that of the voltage sources V32, V33, and V34. The voltage potentials output by the voltage sources V32, V33, and V34 can be the same or can be different. Inductor L31 and switch S34 are electrically connected in series, and inductor L32 and switch S36 are also electrically connected in series.

Figure 8:
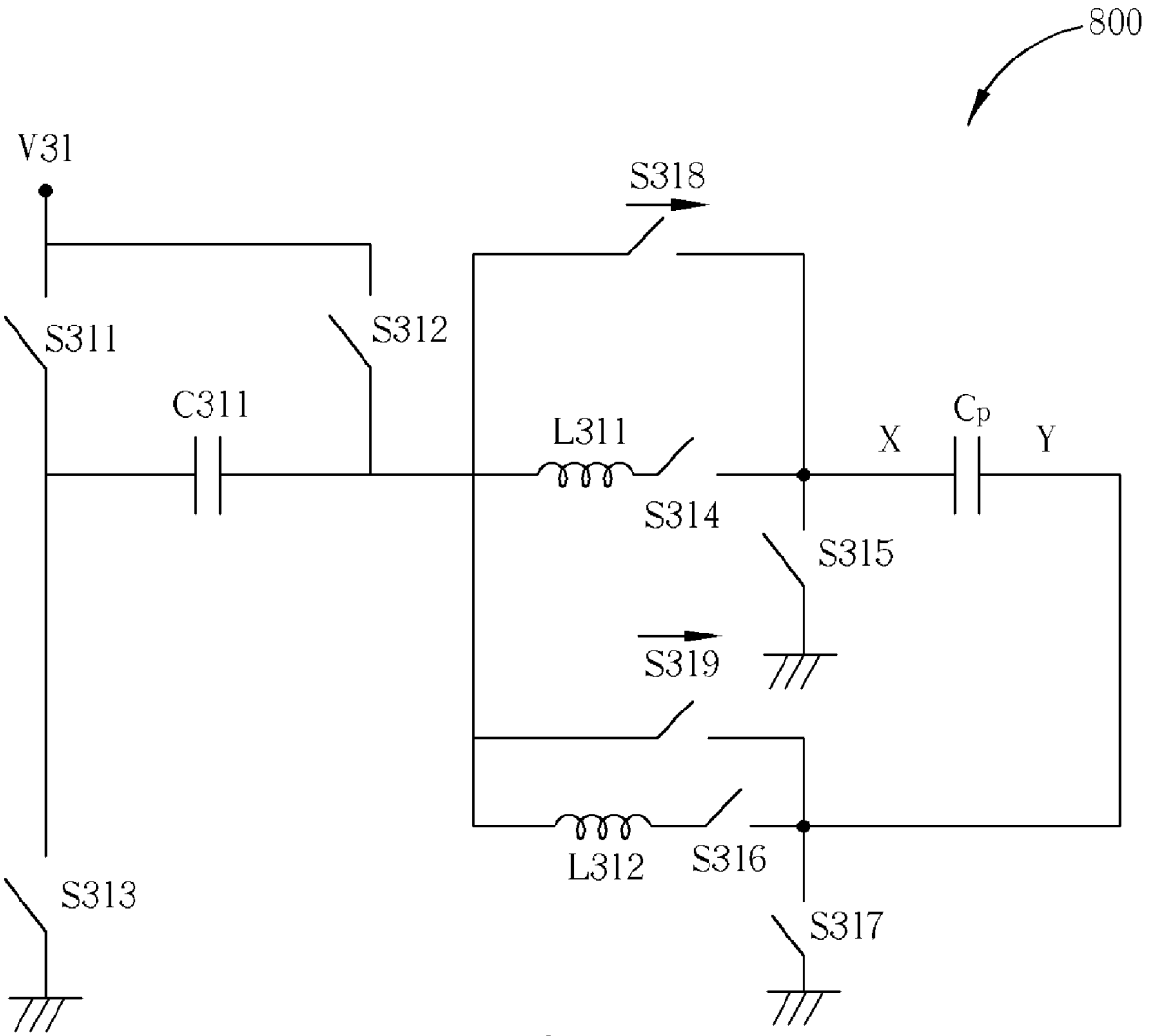
FIG. 8 is shows a circuit diagram of a plasma display panel driving circuit according to a fourth embodiment of the present invention.

Please refer to FIG. 8. FIG. 8 is shows a circuit diagram of a plasma display panel driving circuit 800 according to a fourth embodiment of the present invention. The driving circuit 800 is a special case of the driving circuit 700 shown in FIG. 7 in which the voltage sources V32, V33, and V34 are all ground. All other components of the driving circuit 800 are the same as the driving circuit 700, and switches S311 to S319, capacitor C311, and inductors L311 and L312 correspond to switches S31 to S39, capacitor C31, inductors L31 and L32, respectively.

Figure 9:
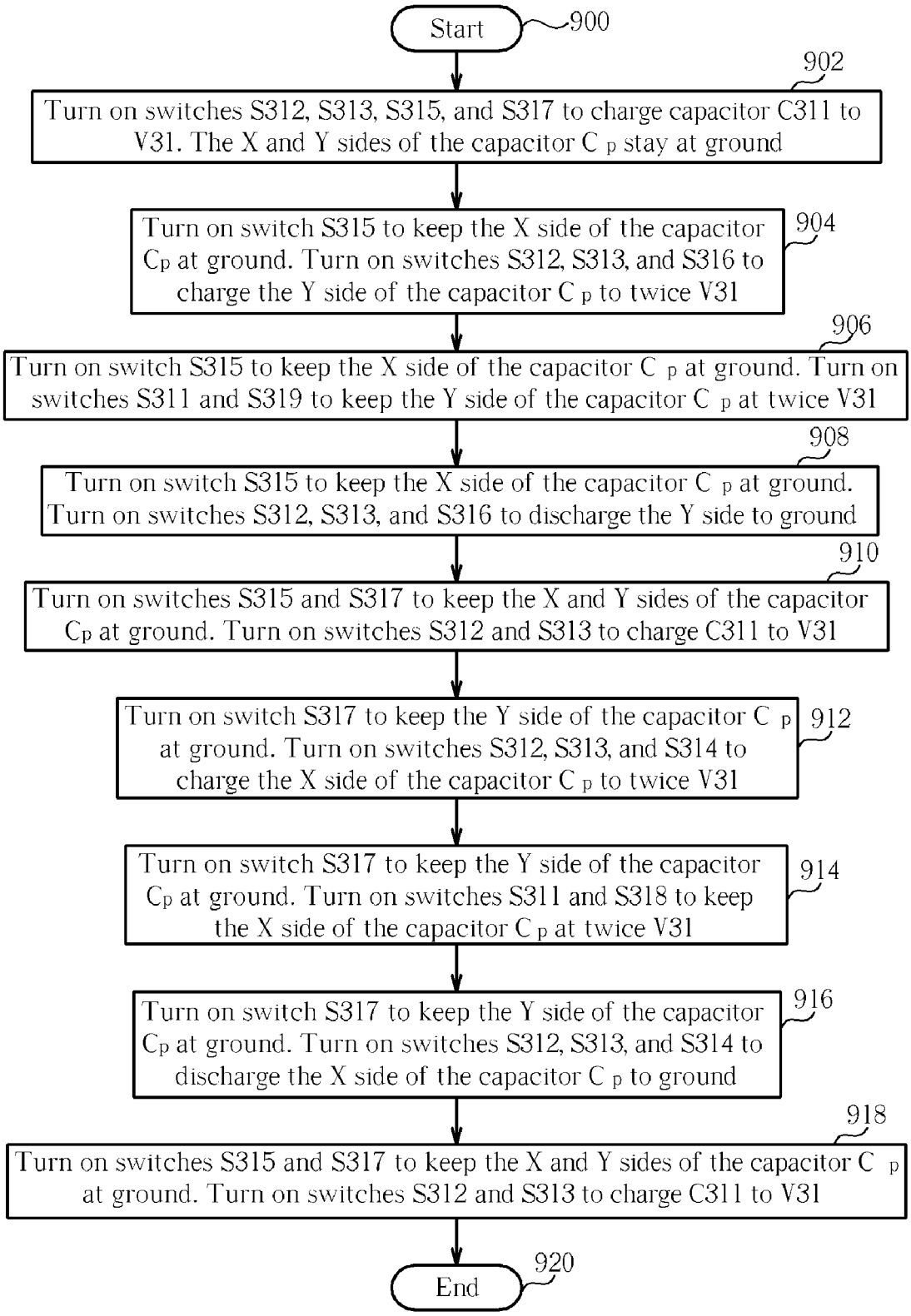
FIG. 9 is a flowchart illustrating the operation of the driving circuit of the fourth embodiment for creating a sustain waveform.

Please refer to FIG. 9, which illustrates the operation of the driving circuit 800 of the fourth embodiment for creating a sustain waveform. Steps contained in the flowchart will be explained as follows.

Step 900: Start.

Step 902: The switches S312, S313, S315, and S317 are turned on. The capacitor C311 is charged to the voltage potential of V31. The positive terminal of C311 is at the node of the connection of S312, S318, and S319. The X side and Y side of the panel equivalent capacitor Cp keep at ground.

Step 904: Keep the voltage potential at the X side of the panel equivalent capacitor Cp at ground by turning on the switch S315. Charge the Y side of the panel equivalent capacitor Cp by turning on the switches S312, S313, and S316. The voltage potential at Y side of the panel equivalent capacitor Cp goes up to twice the voltage potential of V31 through the components S312, S313, S316, L312, and C311.

Step 906: Keep the voltage potential at the X side of the panel equivalent capacitor Cp at ground by turning on the switch S315. Keep the voltage potential at the Y side of the panel equivalent capacitor Cp at twice the voltage potential of V31 by turning on the switches S311 and S319.

Step 908: Keep the voltage potential at the X side of the panel equivalent capacitor Cp at ground by turning on the switch S315. Discharge the Y side of the panel equivalent capacitor Cp by turning on the switches S312, S313, and S316. The voltage potential at Y side of the panel equivalent capacitor Cp goes down to ground through the components S312, S313, S316, L312, and C311.

Step 910: Keep the voltage potential at the X side of the panel equivalent capacitor Cp at ground by turning on the switch S315. Keep the voltage potential at the Y side of the panel equivalent capacitor Cp at ground by turning on the switch S317. In the meantime, the switches S312 and S313 are turned on for charging C311 to V31.

Step 912: Keep the voltage potential at the Y side of the panel equivalent capacitor Cp at ground by turning on the switch S317. Charge the X side of the panel equivalent capacitor Cp by turning on the switches S312, S313, and S314. The voltage potential at X side of the panel equivalent capacitor Cp goes up to twice the voltage potential of V31 through the components S312, S313, S314, L311, and C311.

Step 914: Keep the voltage potential at the Y side of the panel equivalent capacitor Cp at ground by turning on the switch S317. Keep the voltage potential at the X side of the panel equivalent capacitor Cp at twice the voltage potential of V31 by turning on the switches S311 and S318.

Step 916: Keep the voltage potential at the Y side of the panel equivalent capacitor Cp at ground by turning on the switch S317. Discharge the X side of the panel equivalent capacitor Cp by turning on the switches S312, S313, and S314. The voltage potential at X side of the panel equivalent capacitor Cp goes down to ground through the components S312, S313, S314, L311, and C311.

Step 918: Keep the voltage potential at the Y side of the panel equivalent capacitor Cp at ground by turning on the switch S317. Keep the voltage potential at the X side of the panel equivalent capacitor Cp at ground by turning on the switch S315. In the meantime, the switches S312 and S313 are turned on for charging C311 to V31.

Step 920: End.

Figure 10:
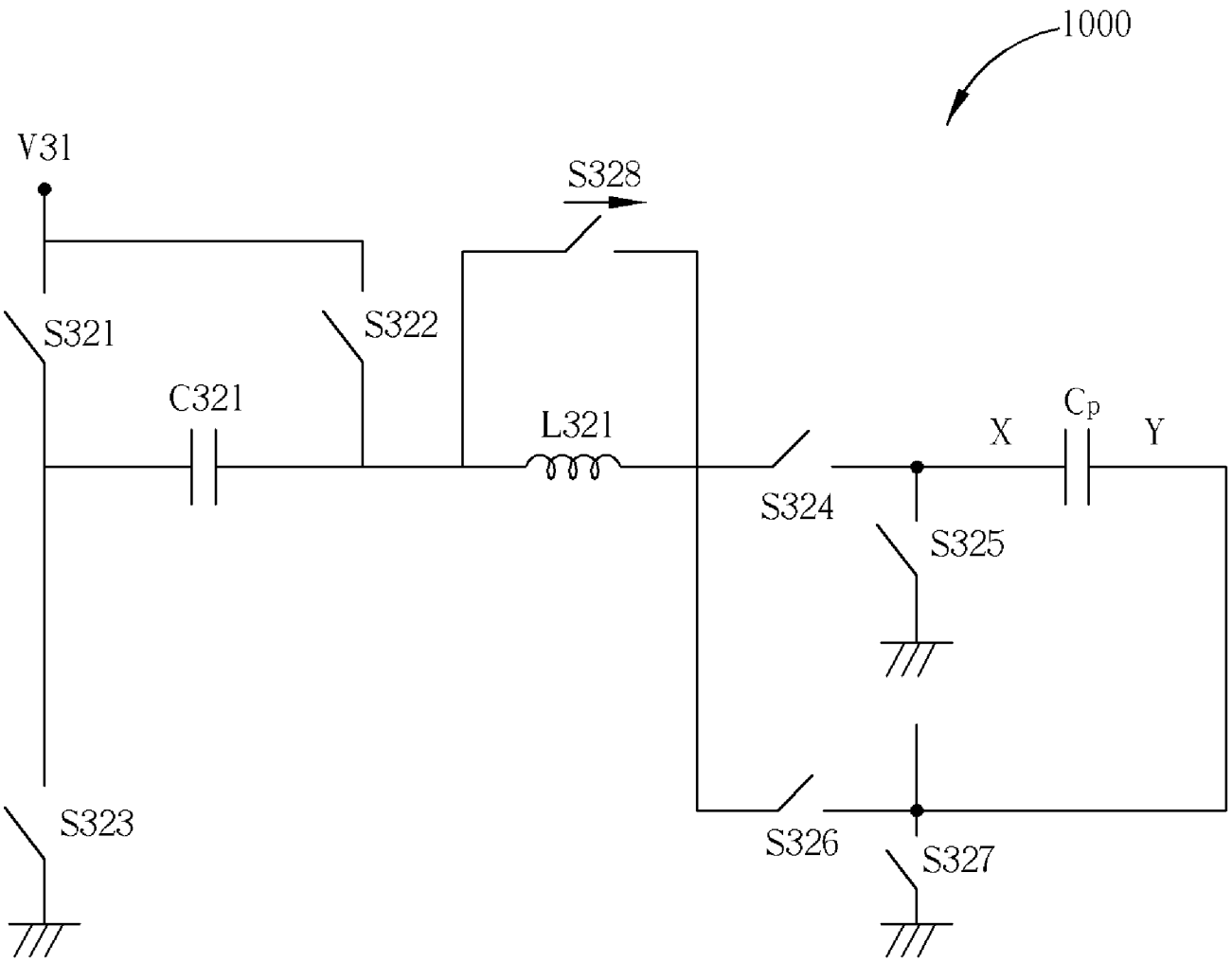
FIG. 10 shows a circuit diagram of a plasma display panel driving circuit according to a fifth embodiment of the present invention.

Please refer to FIG. 10. FIG. 10 shows a circuit diagram of a plasma display panel driving circuit 1000 according to a fifth embodiment of the present invention. The driving circuit 1000 combines the two inductors L311 and L312 shown in FIG. 8 into one and combines the two switches S318 and S319 into one. The driving circuit 1000 comprises switches S321 to S328, a capacitor C321, and an inductor L321. The driving circuit 1000 has an equivalent panel equivalent capacitor Cp of the PDP, which has an X side and a Y side. Switch S328 is a unidirectional switch, and as indicated by the arrows in FIG. 10, the current direction of switch S328 is toward the node formed by the connection of switches S324 and S326.

Figure 11:
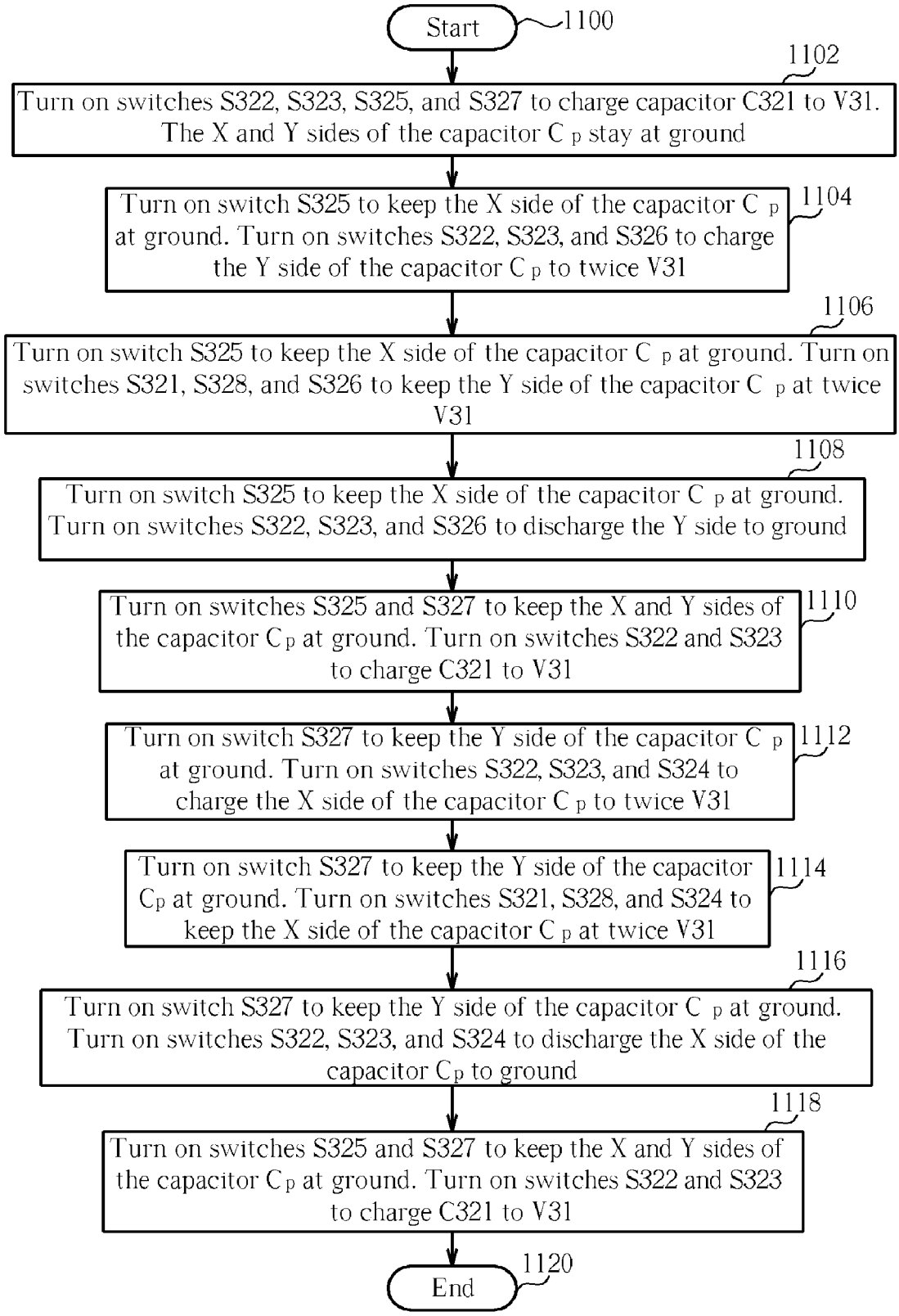
FIG. 11 is a flowchart illustrating the operation of the driving circuit of the fifth embodiment for creating a sustain waveform.

Please refer to FIG. 11, which illustrates the operation of the driving circuit 1000 of the fifth embodiment for creating a sustain waveform. Steps contained in the flowchart will be explained as follows.

Step 1100: Start.

Step 1102: The switches S322, S323, S325, and S327 are turned on. The capacitor C321 is charged to the voltage potential of V31. The positive terminal of C321 is at the node of the connection of S322 and S328. The X side and Y side of the panel equivalent capacitor Cp keep at ground.

Step 1104: Keep the voltage potential at the X side of the panel equivalent capacitor Cp at ground by turning on the switch S325. Charge the Y side of the panel equivalent capacitor Cp by turning on the switches S322, S323, and S326. The voltage potential at Y side of the panel equivalent capacitor Cp goes up to twice the voltage potential of V31 through the components S322, S323, S326, L321, and C321.

Step 1106: Keep the voltage potential at the X side of the panel equivalent capacitor Cp at ground by turning on the switch S325. Keep the voltage potential at the Y side of the panel equivalent capacitor Cp at twice the voltage potential of V31 by turning on the switches S321, S328, and S326.

Step 1108: Keep the voltage potential at the X side of the panel equivalent capacitor Cp at ground by turning on the switch S325. Discharge the Y side of the panel equivalent capacitor Cp by turning on the switches S322, S323, and S326. The voltage potential at Y side of the panel equivalent capacitor Cp goes down to ground through the components S322, S323, S326, L321, and C321.

Step 1110: Keep the voltage potential at the X side of the panel equivalent capacitor Cp at ground by turning on the switch S325. Keep the voltage potential at the Y side of the panel equivalent capacitor Cp at ground by turning on the switch S327. In the meantime, the switches S322 and S323 are turned on for charging C321 to V31.

Step 1112: Keep the voltage potential at the Y side of the panel equivalent capacitor Cp at ground by turning on the switch S327. Charge the X side of the panel equivalent capacitor Cp by turning on the switches S322, S323, and S324. The voltage potential at X side of the panel equivalent capacitor Cp goes up to twice the voltage potential of V31 through the components S322, S323, S324, L321, and C321.

Step 1114: Keep the voltage potential at the Y side of the panel equivalent capacitor Cp at ground by turning on the switch S327. Keep the voltage potential at the X side of the panel equivalent capacitor Cp at twice the voltage potential of V31 by turning on the switches S321, S328, and S324.

Step 1116: Keep the voltage potential at the Y side of the panel equivalent capacitor Cp at ground by turning on the switch S327. Discharge the X side of the panel equivalent capacitor Cp by turning on the switches S322, S323, and S324. The voltage potential at X side of the panel equivalent capacitor Cp goes down to ground through the components S322, S323, S324, L321, and C321.

Step 1118: Keep the voltage potential at the Y side of the panel equivalent capacitor Cp at ground by turning on the switch S327. Keep the voltage potential at the X side of the panel equivalent capacitor Cp at ground by turning on the switch S325. In the meantime, the switches S322 and S323 are turned on for charging C321 to V31.

Step 1120: End.

Figure 12:
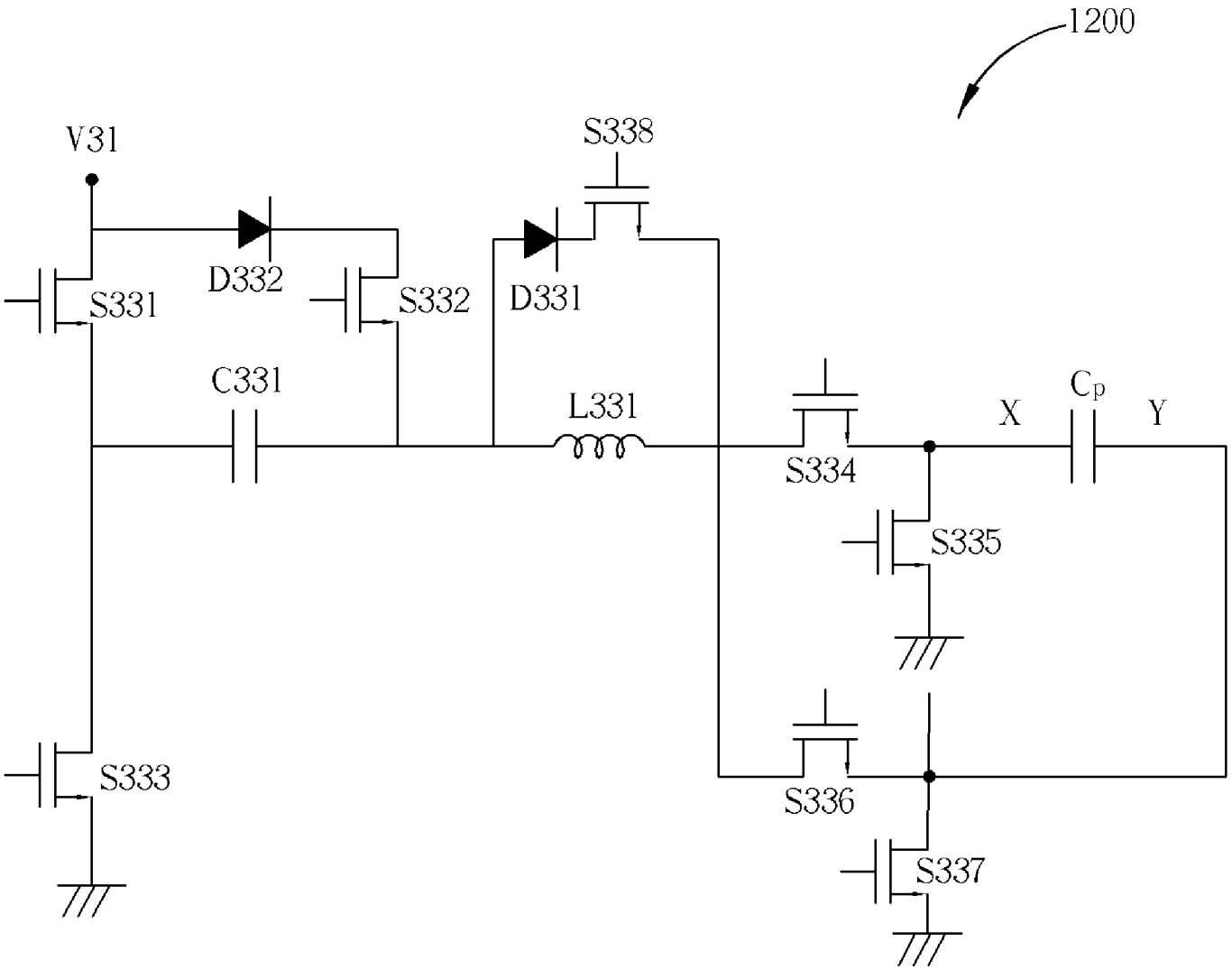
FIG. 12 is shows a circuit diagram of a plasma display panel driving circuit according to a sixth embodiment of the present invention.

Please refer to FIG. 12. FIG. 12 is shows a circuit diagram of a plasma display panel driving circuit 1200 according to a sixth embodiment of the present invention. The driving circuit 1200 comprises switches S331 to S338, capacitor C331, and inductor L331, which correspond to switches S321 to S328, capacitor C321, and inductor L321, of the driving circuit 1000 respectively. Driving circuit 1200 further includes a Diode D332. In the driving circuit 1200, switches S321 to S328 are n-channel MOSFETs, although p-channel MOSFETs and other transistor types such as insulated gate bipolar transistors (IGBT) could also be used as well. Diode D331 and switch S338 together form the unidirectional switch S328 shown in FIG. 10.

In summary, the present invention driving circuits utilize switches to make the sustained voltage twice the voltage potential supplied by the voltage source. The voltage stress of some components will therefore be lower. In addition, the numbers of components can be reduced in the driving circuit.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A plasma display panel driving circuit comprising:

a panel capacitor having a first side and a second side;

a first switch electrically connected between the first side of the panel capacitor and a first voltage;

a first inductor and a second switch electrically connected in series between the first side of the panel capacitor and a first node;

a third switch electrically connected between the first side of the panel capacitor and the first node;

a fourth switch electrically connected between the first node and a second voltage;

a fifth switch electrically connected between the second voltage and a second node;

a first capacitor electrically connected between the first node and the second node;

a sixth switch electrically connected between the second node and the third voltage;

a seventh switch electrically connected between the second side of the panel capacitor and a fourth voltage;

a second inductor and an eighth switch electrically connected in series between the second side of the panel capacitor and a third node;

a ninth switch electrically connected between the second side of the panel capacitor and the third node;

a tenth switch electrically connected between the third node and a fifth voltage;

an eleventh switch electrically connected between the fifth voltage and a fourth node;

a second capacitor electrically connected between the third node and the fourth node; and a twelfth switch electrically connected between the fourth node and the sixth voltage.

2. The plasma display panel driving circuit of claim 1, wherein the second voltage is greater than the first and third voltages, and the fifth voltage is greater than the fourth and sixth voltages.

3. The plasma display panel driving circuit of claim 2, wherein the second and fifth voltages have the same voltage potentials, and the first, third, fourth, and sixth voltages have the same voltage potentials.

4. The plasma display panel driving circuit of claim 3, wherein the second and fifth voltages are supplied by a voltage source and the first, third, fourth, and sixth voltages are ground.

5. The plasma display panel driving circuit of claim 2, wherein the third switch and the ninth switch are unidirectional switches.

6. The plasma display panel driving circuit of claim 5, wherein current only passes through the third switch toward the first side of the panel capacitor, and current only passes through the ninth switch toward the second side of the panel capacitor.

7. The plasma display panel driving circuit of claim 1, wherein the first inductor is coupled to the first node and the second switch is electrically connected between the first inductor and the first side of the panel capacitor, and the second inductor is coupled to the third node and the eighth switch is electrically connected between the second inductor and the second side of the panel capacitor.

8. The plasma display panel driving circuit of claim 1, wherein the first through twelfth switches are transistors.

9. The plasma display panel driving circuit of claim 8, wherein the transistors are P-type or N-type metal oxide semiconductor (MOS) transistors or insulated gated bipolar transistors (IGBT).

10. A plasma display panel driving circuit comprising:

a panel capacitor having a first side and a second side;

a first switch electrically connected between the first side of the panel capacitor and a first voltage;

a second switch electrically connected between the second side of the panel capacitor and a second voltage;

a third switch electrically connected between the second side of the panel capacitor and a first node;

a fourth switch and a first inductor electrically connected in series between the second side of the panel capacitor and the first node;

a fifth switch and a second inductor electrically connected in series between the first side of the panel capacitor and the first node;

a sixth switch electrically connected between the first side of the panel capacitor and the first node;

a seventh switch electrically connected between the first node and a third voltage;

an eighth switch electrically connected between the third voltage and a second node;

a capacitor electrically connected between the first node and the second node; and a ninth switch electrically connected between the second node and a fourth voltage.

11. The plasma display panel driving circuit of claim 10, wherein the third voltage is greater than the first, second, and fourth voltages.

12. The plasma display panel driving circuit of claim 11, wherein the first, second, and fourth voltages have the same voltage potentials.

13. The plasma display panel driving circuit of claim 12, wherein the third voltage is supplied by a voltage source and the first, second, and fourth voltages are ground.

14. The plasma display panel driving circuit of claim 11, wherein the third switch and the sixth switch are unidirectional switches.

15. The plasma display panel driving circuit of claim 14, wherein current only passes through the third switch toward the second side of the panel capacitor, and current only passes through the sixth switch toward the first side of the panel capacitor.

16. The plasma display panel driving circuit of claim 10, wherein the first inductor is coupled to the first node and the fourth switch is electrically connected between the first inductor and the second side of the panel capacitor, and the second inductor is coupled to the second node and the fifth switch is electrically connected between the second inductor and the first side of the panel capacitor.

17. The plasma display panel driving circuit of claim 10, wherein the first through ninth switches are transistors.

18. The plasma display panel driving circuit of claim 17, wherein the transistors are P-type or N-type metal oxide semiconductor (MOS) transistors or insulated gate bipolar transistor (IGBT).

19. A plasma display panel driving circuit comprising:

a panel capacitor having a first side and a second side;

a first switch electrically connected between the first side of the panel capacitor and a first voltage;

a second switch electrically connected between the second side of the panel capacitor and a second voltage;

a third switch electrically connected between the first side of the panel capacitor and a first node;

a fourth switch electrically connected between the second side of the panel capacitor and the first node;

an inductor electrically connected between the first node and a second node;

a fifth switch electrically connected between the first node and the second node;

a sixth switch electrically connected between the second node and a third voltage;

a seventh switch electrically connected between the third voltage and a third node;

a first diode electrically connected between the sixth switch and the seventh switch;

a capacitor electrically connected between the second node and the third node; and an eighth switch electrically connected between the third node and a fourth voltage.

20. The plasma display panel driving circuit of claim 19, wherein the third voltage is greater than the first, second, and fourth voltages.

21. The plasma display panel driving circuit of claim 20, wherein the first, second, and fourth voltages have the same voltage potentials.

22. The plasma display panel driving circuit of claim 21, wherein the third voltage is supplied by a voltage source and the first, second, and fourth voltages are ground.

23. The plasma display panel driving circuit of claim 20, wherein the fifth switch is a unidirectional switch.

24. The plasma display panel driving circuit of claim 23, wherein current only passes through the fifth switch toward the first node.

25. The plasma display panel driving circuit of claim 24, wherein the fifth switch comprises a second diode electrically connected in series between the first node and the second node.

26. The plasma display panel driving circuit of claim 19, wherein the first through eighth switches are transistors.

27. The plasma display panel driving circuit of claim 26, wherein the transistors are P-type or N-type metal oxide semiconductor (MOS) transistors or insulated gate bipolar transistors.

* * * * *